US006789694B1

(12) United States Patent
McCullough

(10) Patent No.: US 6,789,694 B1
(45) Date of Patent: Sep. 14, 2004

(54) NAPKIN DISPENSER

(76) Inventor: Wilburn L. McCullough, 1001 N. Richard St., Carlsbad, NM (US) 88220

( * ) Notice: Subject to any disclaimer, the term of this patent is extended or adjusted under 35 U.S.C. 154(b) by 30 days.

(21) Appl. No.: 10/346,826

(22) Filed: Jan. 17, 2003

(51) Int. Cl.[7] ..... B65H 3/00
(52) U.S. Cl. ..... 221/43; 221/213
(58) Field of Search ..... 221/33, 43, 42, 221/45, 56, 210, 213, 277, 259

(56) References Cited

U.S. PATENT DOCUMENTS

| | | | | |
|---|---|---|---|---|
| 1,486,079 A | | 3/1924 | Fernandez | |
| 1,553,954 A | | 9/1925 | Parsons | |
| 1,703,594 A | * | 2/1929 | Pratt | 221/23 |
| 1,752,885 A | * | 4/1930 | Carroll | 221/41 |
| 2,639,959 A | | 5/1953 | Couden | |
| 3,117,694 A | * | 1/1964 | Gothreau | 221/23 |
| 4,662,536 A | | 5/1987 | Powers | |
| 4,732,255 A | | 3/1988 | Bullard | |
| 5,137,134 A | | 8/1992 | La Spina | |
| 5,335,817 A | | 8/1994 | Powers | |
| 5,388,724 A | | 2/1995 | Adams | |
| 5,630,581 A | | 5/1997 | Rodesch | |

* cited by examiner

*Primary Examiner*—Kenneth Noland
(74) *Attorney, Agent, or Firm*—LaValle D. Ptak

(57) ABSTRACT

A napkin dispenser is designed with a flat base to rest on a horizontal surface. A substantially perpendicular flat front plate is mounted on the base, and a stack of napkins, resting on their edges on the base, is biased toward engagement with the front plate. The front plate carries a movable friction member, which may be in the form of a rotating device or a reciprocally mounted member, for engaging a napkin adjacent the front plate and moving it upwardly to remove it from the stack of napkins. The dispenser may be designed in kit form with different removable front plates, each carrying a different type of friction member.

13 Claims, 6 Drawing Sheets

NAPKIN DISPENSER

BACKGROUND

Paper napkins are in widespread use, both in commercial establishments such as restaurants, fast food outlets and the like, and in private homes. Typically, paper napkins are placed in some type of holder for neatness and to limit the number of napkins which may be withdrawn from a stack of napkins by a-user. For some commercial napkin dispensers, a stack of napkins is placed inside a holder and a spring-loaded plate biases the napkins toward an opening. The napkins are folded in such a way that a person desiring to withdraw napkins from the holder can grasp only the front or lead napkin and pull it from the stack, thereby requiring the user to continually repeat drawing the front napkin from the stack until as many napkins as are desired have been withdrawn. This is a completely manual system; but it is one which is in widespread use in many restaurants and fast food outlets throughout the world.

Napkins which are designed for home use, however, typically are placed in open containers which allow a person to withdraw a napkin, either from the top of a horizontally oriented stack, or from the front edge of a vertically oriented stack. In either case, more than one napkin may be withdrawn at a time because it is difficult to grasp only the top or lead napkin from the stack. Consequently, it becomes necessary for the user to replace napkins in excess of the number desired back into the stack, or the excess number of napkins withdrawn simply is wasted. Neither of these results are desirable.

A number of devices have been devised for storing and disposing individual articles, such as napkins, paper towels and newspapers. Most of these devices are designed to deliver the stored articles one at a time, upon demand by a user. Three United States patents to Fernandez U.S. Pat. No. 1,486,079; Bullard U.S. Pat. No. 4,732,255; and LaSpina U.S. Pat. No. 5,137,134, are directed to devices for dispensing newspapers or napkins by means of friction rollers biased downwardly (either by gravity or some other means) onto the top of the stack of items to be dispensed. Rotation of the roller, in all of the devices disclosed in these patents, then pulls the top item off the stack and delivers it from the device. In the LaSpina patent, the roller is biased by means of gravity onto the top of a stack of newspapers, which are placed on a solid or fixed base. In the Fernandez and Bullard devices, a spring on the bottom of the stack pushes the stack of articles up into contact with a roller, which then is rotated to dispense the top article from the stack.

Four United States patents, to Couden U.S. Pat. No. 2,639,959; Powers U.S. Pat. No. 4,662,536; Powers U.S. Pat. No. 5,335,817; and Adams U.S. Pat. No. 5,388,724, are directed to friction rollers which are located on the bottom of a stack (in most cases, a stack of coffee filters) to remove an item from the bottom of the stack and to dispense it from the container holding the items. Rotating friction rollers are used in both of the Powers patents, and in the Couden device. In the device of Adams, a rotating lever is used to pick off the bottom coffee filter and deliver it out of the bottom of the container.

The United States patents to Parsons U.S. Pat. No. 1,553,954; Pratt U.S. Pat. No. 1,703,594; Carroll U.S. Pat. No. 1,752,885; and Gothreau U.S. Pat. No. 3,177,694 are directed to devices using rotating drums to remove an article, such as a napkin, from one side of a vertical stack (edge-stacked articles) to deliver it, either upwardly or downwardly, out of the container holding the stack of articles. Springs or gravity plates are used to press the stack of articles into the roller; so that the roller snugly engages the next item to be delivered from the container until all of the items have been removed from the container.

These patents disclose mechanisms of varying degrees of complexity; and two of them, Pratt and Gothreau, function to provide a fold in the article which is being removed from the container. The Pratt device basically employs a pair of rotating drums to effect the delivery.

Another United States patent, to Rodesch U.S. Pat. No. 5,630,581, employs a roller rotated one way and then another, on the bottom of a stack of articles to pull a bottom napkin from the stack and deliver it from the bottom of the container. United States patent application publication U.S. 2001/0032859A1 also is directed to a napkin dispenser for dispensing vertical or edge stacked napkins one at a time from an open-topped napkin holder. A friction roller having a number of pins or projections on it is rotated against the forward napkin of the stack to push it upwardly out of the container. The stack of napkins is pressed against the roller by means of a gravity-biased plate located at the rear of the stack. The roller is mounted inside the container on a shaft extending through opposite sides of the container; and various mechanisms are used to rotate the roller to lift the napkin out of the container. The mechanisms for operating the roller, in some cases, are relatively complex arrangements of levers, pulleys and belts; and the roller itself occupies a substantial amount of space within the container; so that the overall structure is somewhat bulky.

It is desirable to provide an easy to use napkin dispenser which is simple, both in construction and operation, and which overcomes the disadvantages of the prior art.

SUMMARY OF THE INVENTION

It is an object of this invention to provide an improved device for dispensing articles from a stack of articles.

It is another object of this invention to provide an improved napkin dispenser.

It is an additional object of this invention to provide an improved napkin dispenser for dispensing napkins one at a time from a stack of napkins.

It is a further object of this invention to provide an improved napkin dispensing kit allowing a user to choose different mechanisms for effecting the dispensing of napkins one at a time from a stack of napkins.

In accordance with a preferred embodiment of the invention, a napkin dispenser includes a substantially flat base member adapted to be placed on a horizontal surface to hold a stack of napkins oriented with the lower edges of the napkins resting on the base member. A substantially flat front plate is attached to the base member and extends upwardly from the base member. A device is provided to urge a stack of napkins toward engagement with the front plate; and a movable friction member is mounted on the front plate for moving a napkin adjacent the front plate upwardly to remove the napkin from the stack of napkins.

The napkin dispenser may be provided in the form of a kit having a plurality of front plates which may be removably attached to the base member, with each of the plurality of front plates carrying a different mechanism for operating the movable friction member.

DETAILED DESCRIPTION

The same reference numbers are used throughout the different figures to designate the same or similar components. Reference first of all should be made to FIGS. 1, 2 and 3, which illustrate a first preferred embodiment of the invention.

Figure 1:
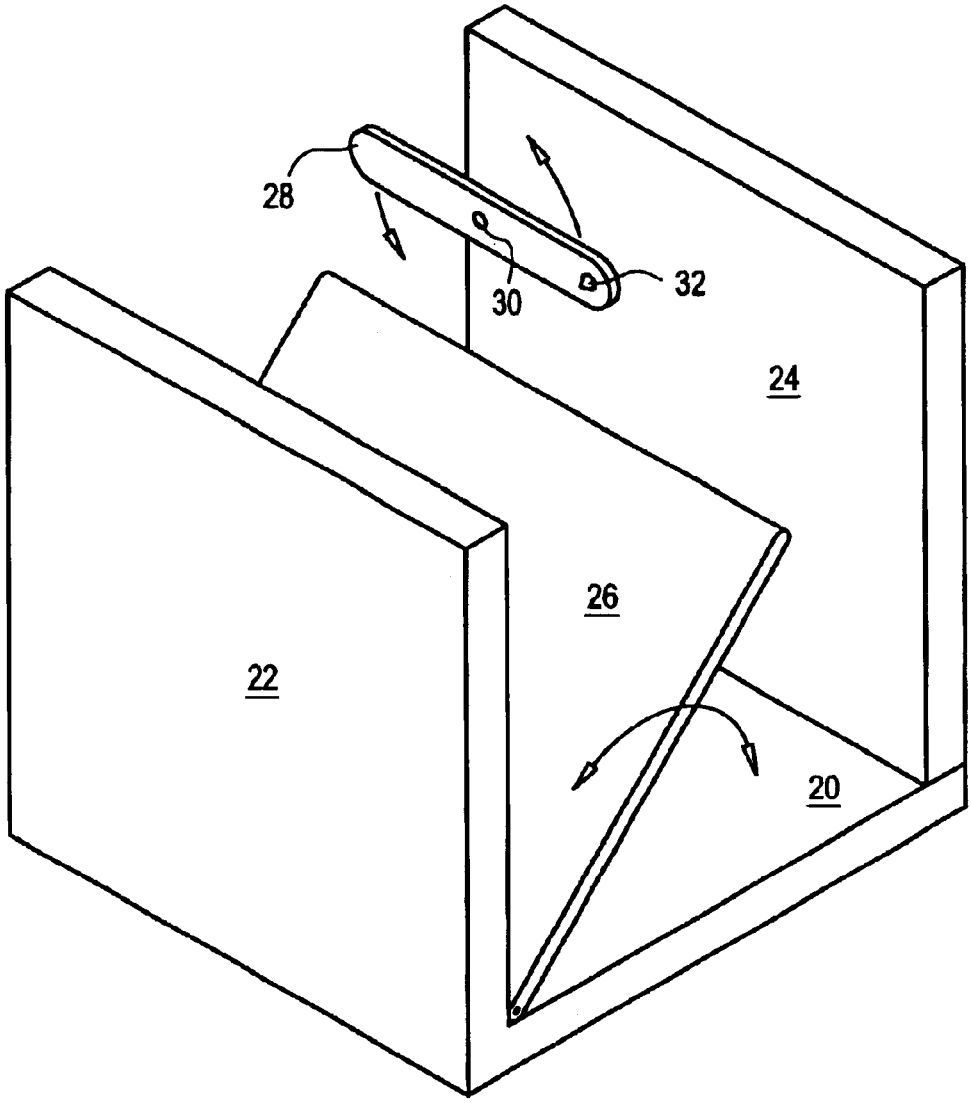
FIG. 1 is a top rear perspective view of a preferred embodiment of the invention.
Figure 2:
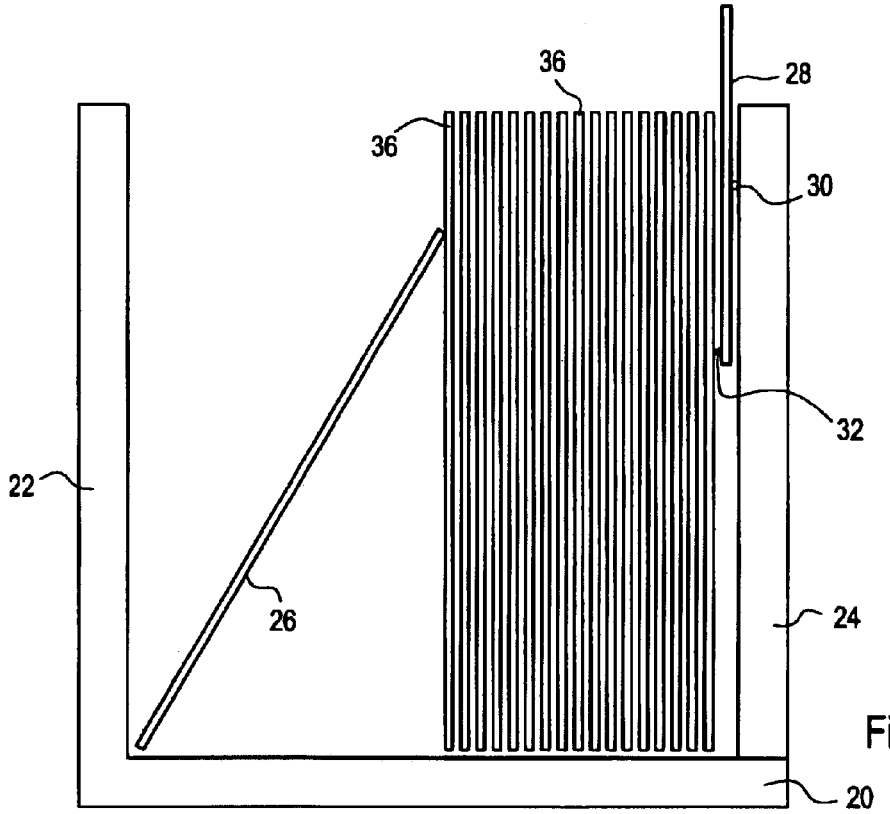
FIGS. 2 and 3 are side views of the embodiment shown in FIG. 1 illustrating aspects of the operation of the device shown in FIG. 1.
Figure 3:
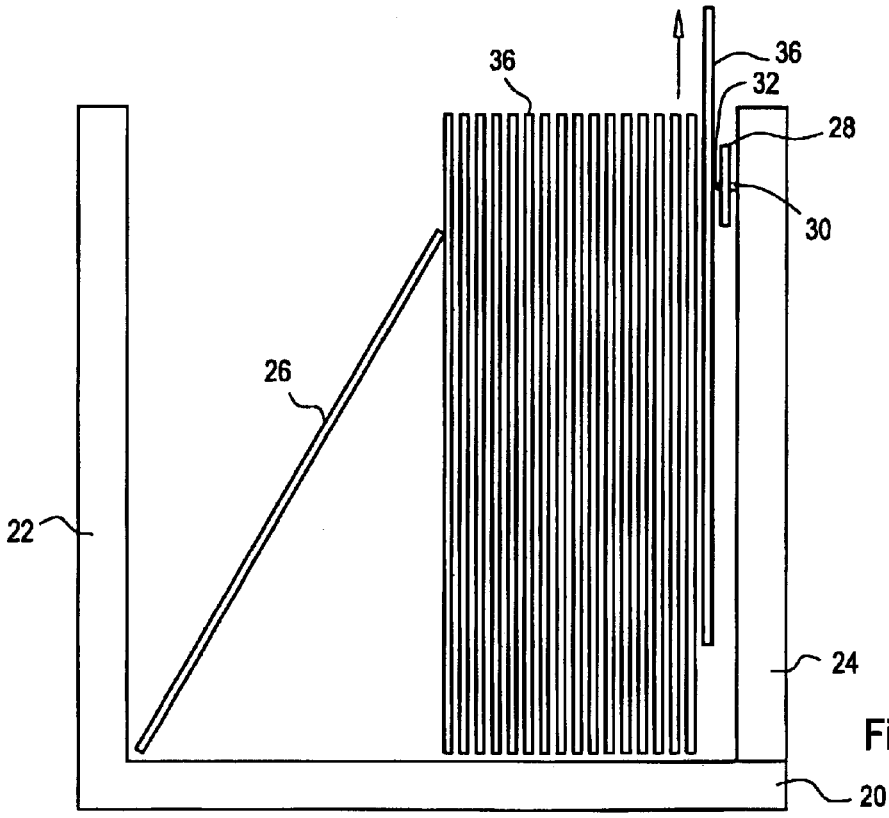

The basic structure of the napkin dispenser shown in FIGS. 1, 2 and 3 includes a flat rectangular base 20, which is designed to rest upon an underlying horizontal supporting surface. In the embodiment shown in these figures, a rear panel or wall 22 is attached to one end of the base 20. The opposite end of the base 20 has a removable front wall or panel 24 attached to it and extending perpendicular to the plane of the base 20. The manner in which the panel 24 is removably attached to the base is illustrated most clearly in the exploded view of another embodiment of the invention in FIG. 8. It should be noted that the panel 24 which is shown throughout the different figures of the drawings is designed to be removably attached to the base 20. This includes all of the embodiments shown in FIGS. 1 through 12.

The basic structure of the primary napkin dispenser also includes a pivotally mounted gravity biasing plate 26, which typically is formed of steel or aluminum. As illustrated, the plate 26 is pivoted about its lower left hand edge at the junction of the rear panel 22 and the base 20. Obviously, the rear panel 22 could be dispensed with; and the gravity plate. 26 could be pivotally attached, by means of a hinge or other suitable apparatus, directly to the left hand edge of the base 20. The manner in which the plate 26 is designed to effect the pivotal movement shown by means of the double direction arrow in FIG. 1 is not important. It also should be noted that when a rear panel 22, as illustrated in FIGS. 1, 2 and 3, is used, no physical connection between the plate 26 and either of the base 20 or the panel 22 is necessary, since the junction between the rear panel 22 and the upper surface of the base 20 provides a resting or pivot point for a free standing biasing plate 26, if such should be desired.

As illustrated in FIGS. 2 and 3, the plate 26 presses against the rear of a stack of vertically oriented napkins 36, which are arranged with the bottom edges of the napkins resting on the top surface of the base 20. The weight of the plate 26 is empirically chosen to press the stack of napkins. 36 forwardly to continually move the stack toward the front plate 24 with sufficient force to allow the stack to engage a friction member mounted on the front plate 24; so that one napkin at a time (the one adjacent the plate 24), may be removed by means of the various frictional members described in conjunction with the different embodiments of the invention in the following paragraphs.

If the weight 26 is too heavy, the force pressing the napkins toward the plate 24 may be so great that multiple napkins 36 will be removed from the device; or, in the case of some of the frictional members, napkins could be torn. Consequently, the desired weight for the plate 26 is selected empirically in conjunction with the particular type of napkins 36 or other sheet articles which are to be dispensed from the dispenser.

As shown in FIGS. 1, 2 and 3, the friction member designed for moving one napkin at a time from the front or right hand end of the stack, as shown in FIGS. 2 and 3, is a simple straight lever 28, which is pivoted about a pivot pin 30 located adjacent the left hand edge of the front plate 24 (as viewed in FIG. 1). The location of the pivot pin 30 also is near the upper edge of the plate 24, as shown clearly in FIGS. 1, 2 and 3.

When the lever 28 is in its uppermost or near vertical position, as shown in FIG. 2, the device is ready to dispense the next napkin from the stack. Pivoting the lever 28 in the direction of the arrows shown in FIG. 1 to the position shown in FIG. 3 causes a pin 32 mounted on the inside end of the lever 28 to move upwardly while engaging the front napkin 36 of the stack to push that napkin 36 upwardly off the base 20 to the position shown in FIG. 3 to allow it readily to be grasped and withdrawn from the dispenser. This operation may be repeated by moving the lever 28 back to the position shown in FIG. 2, and rotating it again as shown in FIGS. 1 and 3 to lift the next napkin off the stack. Stops (not shown) may be provided on the left hand edge of the panel 24 (as shown in FIG. 1) to limit both the movement of the lever 28 and prevent it from somehow getting buried behind the stack of napkins. Whether such limit stops are provided, however, is not important to an understanding of the operation of the device of FIGS. 1, 2 and 3. The lever 28 operates as described above whether or not such limit stops are provided.

Figure 4:
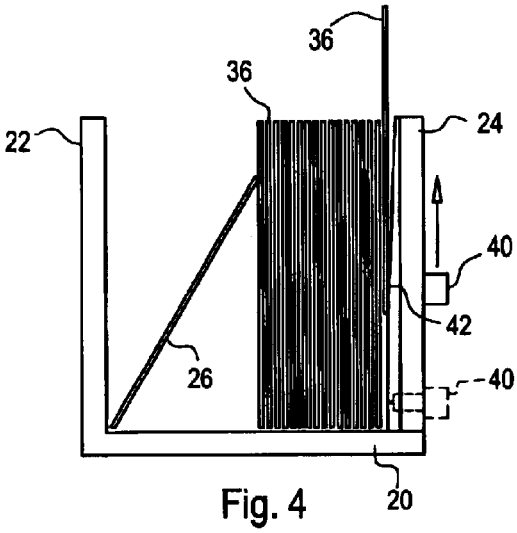
FIGS. 4 and 5 are side views illustrating the operation of an alternative embodiment of the invention shown in FIG. 1.
Figure 5:
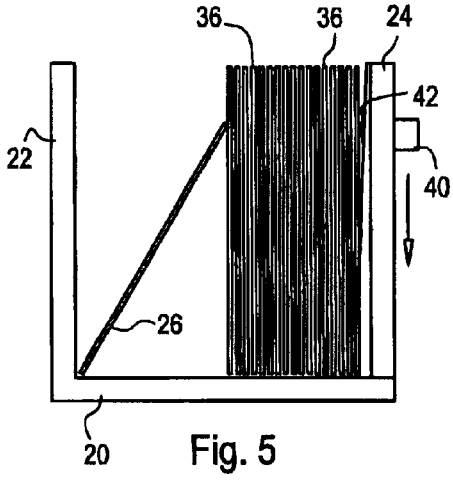
Figure 6:
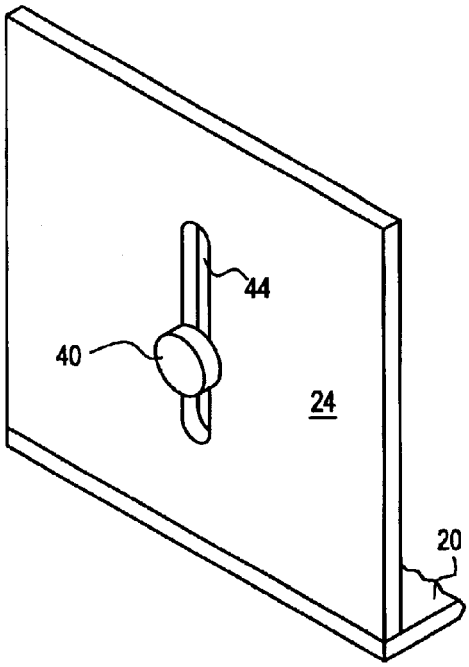
FIGS. 6 and 7 are front and rear views, respectively, of the operating mechanism illustrated in the diagrams of FIGS. 4 and 5.
Figure 7:
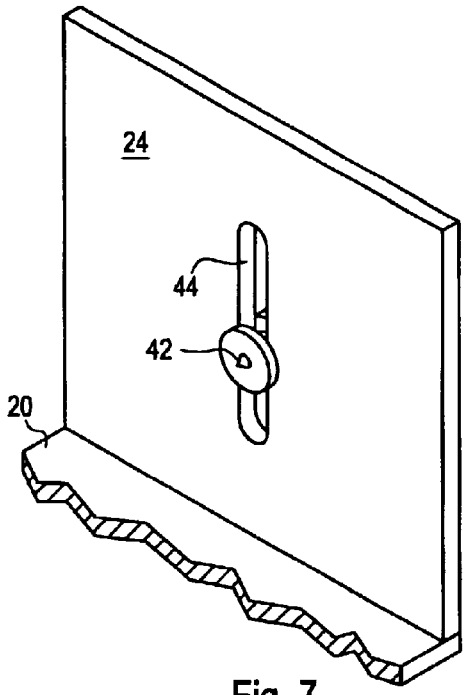

FIGS. 4, 5, 6 and 7 are directed to an alternative to the embodiment shown in FIG. 1. Instead of rotating a pivot pin 32 on the end of a lever 28, as shown in the embodiment of FIGS. 1 through 3, a direct reciprocating vertical movement of a friction pin 42 is employed. In the embodiment of FIGS. 4, 5, 6 and 7, the pin 42 is carried on a shaft attached through a vertical slot 44 in the front plate 24, with a knob or operator 40 located on the outside (left hand side as shown in FIG. 6) to allow a person to grasp the knob and move it up and down to effect the removal of a napkin. To remove a napkin with the embodiment shown in FIGS. 4 through 7, the knob 40 first is moved upwardly from the lowermost position in the slot 44, as shown in dotted lines in FIG. 4.

As the knob 40 is moved up, it carries the pin 42 upwardly, as shown in the solid line position in FIG. 4, to lift the front napkin 36 off the stack and up and out of the dispenser, as illustrated in FIG. 4. When the napkin 36 which has been lifted up has been removed, the knob 40 is moved back downwardly, as shown in FIG. 5, to prepare the assembly for removal of the next napkin.

It should be noted that the pin 32 and the pin 42 shown in the embodiments of FIGS. 1 through 3 and of FIGS. 4 through 7, may be a simple sharp-pointed device; or it may be configured with a hook or "J-like" shape, with the point directed upwardly so that when the pin 32 or 42 moves upwardly, it engages the napkin and extends into the napkin surface to lift it away from the stack of napkins. Then, when the pins 32 or 42 are moved downwardly, in either of these embodiments, the smooth or curved portion of the hook slides downwardly on the face of the napkins; so that no tearing of napkins or bunching of napkins into the holder takes place. This type of configuration of the pins 32 and 42 is preferred to a straight pin configuration, in order to minimize potential damage to napkins and to minimize potential mis-operation of the device. The shape of the pin, however, may be configured as desired to meet various operating conditions of the particular arrangement which is used.

Figure 8:
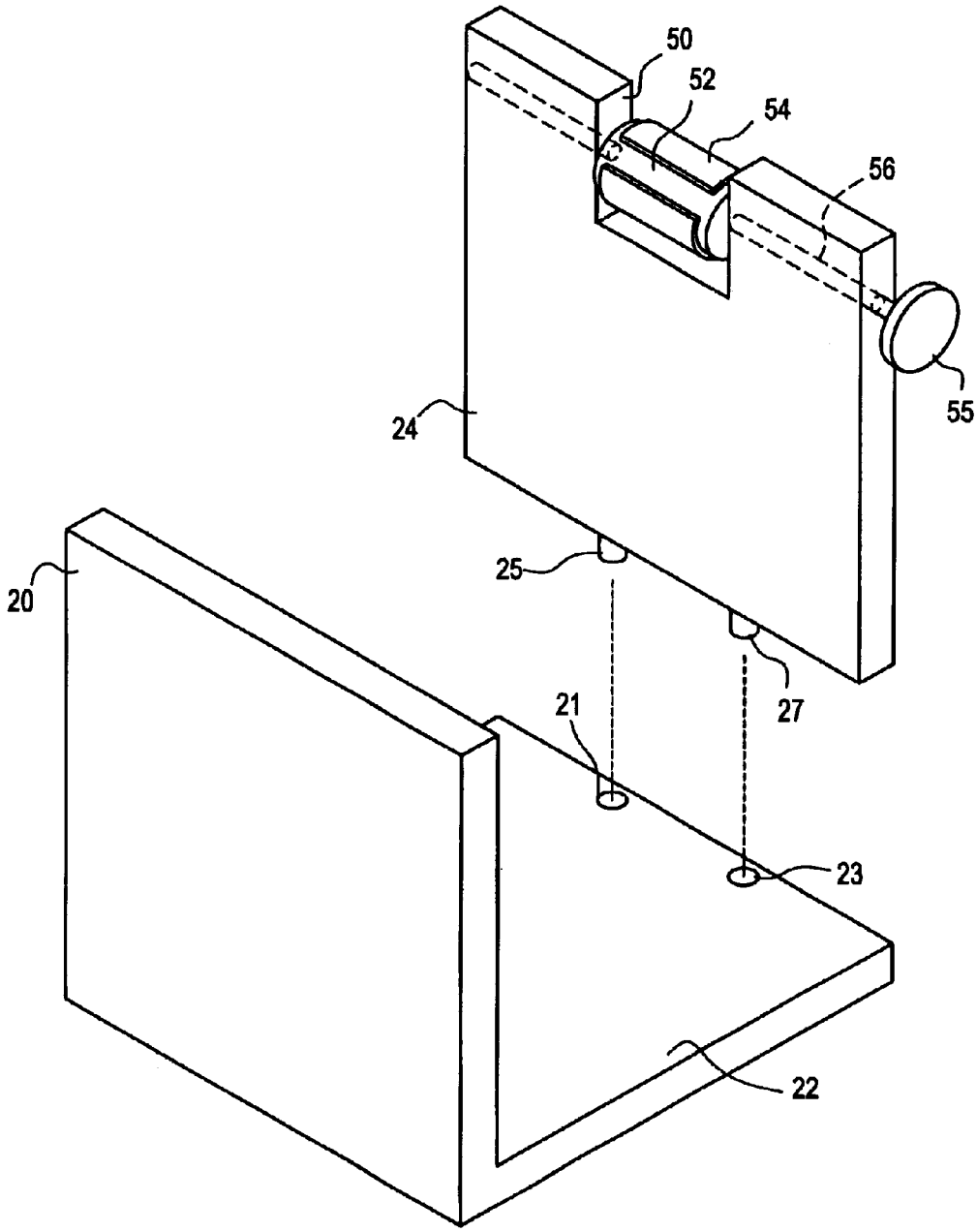
FIG. 8 illustrates a variation of the embodiment shown in FIGS. 1 through 7.

FIG. 8 is directed to another alternative embodiment of the invention. This figure also illustrates the manner in which the front plate 24 may be made readily removable from the base 20 to accommodate any one of the different embodiments shown in the various figures of the drawing. The base 20 includes two holes 21 and 23 on its upper surface; and these holes mate with downwardly projecting pins 25 and 27 mounted on the lower edge of each of the front plates 24. The front plates 24 then may simply be dropped into place to insert the pins 25 and 27 into the respective holes 21 and 23 to effect the completed assemblies, for example as illustrated in FIGS. 1 through 7. By doing this, all of the different front plates 24 which are illustrated, including the ones which have been described above, may be interchangeably employed in the napkin dispenser to permit a user to choose whichever one of the various front plates 24 that particular user finds to be the most suitable for his or her particular situation.

In the embodiment shown in FIG. 8, the base 20, the back 22 and the front plate 24 are employed in conjunction with the gravity plate 26 shown in detail in FIG. 1. The gravity plate 26 has not been shown in FIG. 8 in order to illustrate other features of the invention, namely the pins 25 and 27 and holes 21 and 23.

In the embodiment of FIG. 8, the friction member is in the form of a roller 52, which is mounted on a shaft 56 in a rectangular slot 50 in the top of the plate 24. The roller 52 has its surface covered with a friction material 54, which may be sandpaper, soft rubber material, or any suitable friction material.

The shaft 56 is illustrated as extending through the upper portion of the-front plate 24, and extends outwardly to terminate in a knob 55. When the knob 55 is rotated clockwise, the friction surface 54 is rotated clockwise (as viewed in FIG. 8) to move a front napkin 36 pressing against it upwardly out of the dispenser in the same manner as described previously in conjunction with FIGS. 2 and 3 and FIGS. 4 and 5.

Figure 9:
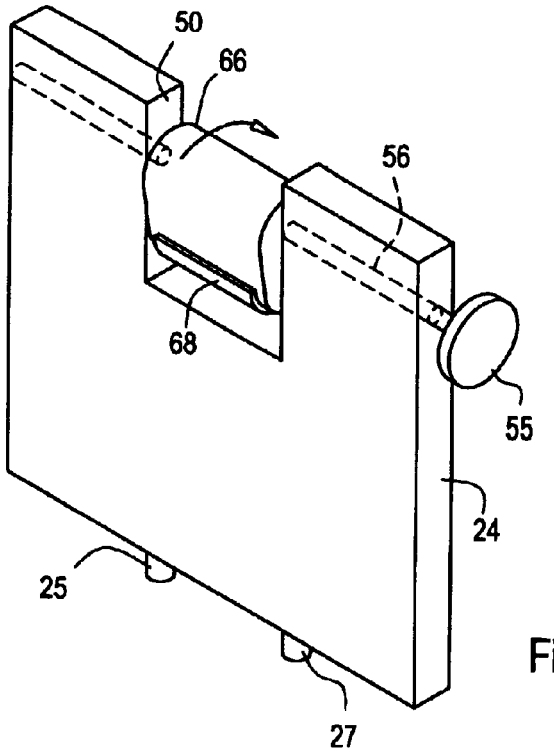
FIG. 9 is directed to an alternative of the embodiment shown in FIG. 8.

FIG. 9 illustrates another alternative to the embodiment shown in FIG. 8; and in order to avoid unnecessary cluttering of the drawing, only the front plate 24 is illustrated in FIG. 9. It should be understood that the base 20 and rear panel 22, along with the gravity plate 26, are included in conjunction with the portion of the embodiment shown in FIG. 9.

The embodiment shown in FIG. 9 is quite similar to the one of FIG. 8; and an eccentric cam 66 is employed in place of the cylindrical roller 52 shown in FIG. 8. The edge of the cam 66, which extends the greatest distance into the space behind the front plate 24 when the cam 66 is rotated, is covered with a friction surface 68. The friction surface 68, again, may be sandpaper, soft rubber, or any other suitable material. The cam 66 is mounted on a shaft 56 and rotated by a knob 55 in the same manner described above in conjunction with the embodiment of FIG. 8. When the cam is rotated in the direction shown by the arrow in FIG. 9, the friction surface 68 engages the forwardmost napkin adjacent the plate 24 and lifts it out of the dispenser. Further rotation of the cam 66 moves the friction surface away from the napkin; so that it easily may be withdrawn by a person using the device.

Figure 10:
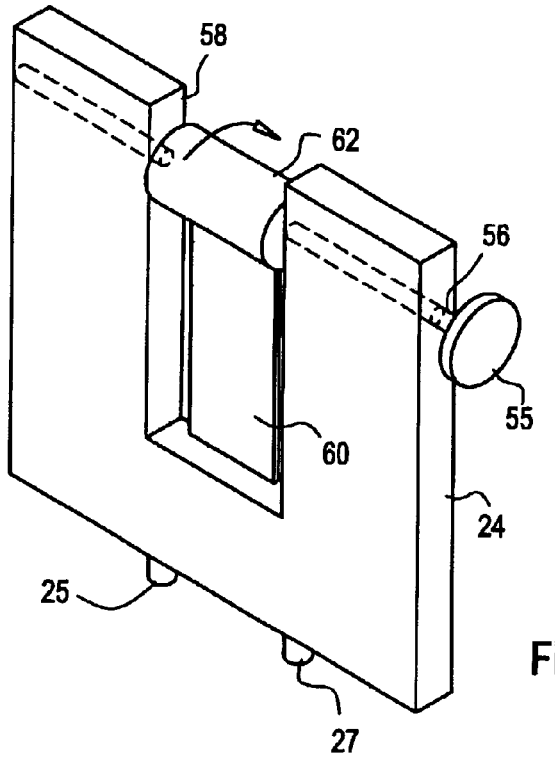
FIG. 10 is directed to another alternative of the embodiment shown in FIG. 8.

The embodiment shown in FIG. 10 is an alternative to the embodiments of FIGS. 8 and 9, and employs a cylindrical roller 62 mounted on a shaft 56 and rotated by a knob 55 in the same manner as described above in conjunction with FIGS. 8 and 9. The slot 58 in the front plate 24, however, extends to a greater depth than the slot 50 of FIGS. 8 and 9 to allow for movement of a flexible tongue, which may be made of rubber or soft plastic. As the device is rotated in the direction of the arrow shown in FIG. 10, the tongue engages the first napkin adjacent the plate 24 and pushes it upwardly until the continued rotation of the knob 55 pulls the tongue out of engagement and toward the right (as viewed in FIG. 10) to again allow it to swing around to the position shown in FIG. 10. By this time, however, the leading napkin adjacent the plate 24 has been lifted; so that it easily may be grasped and removed from the stack of napkins 36.

Figure 11:
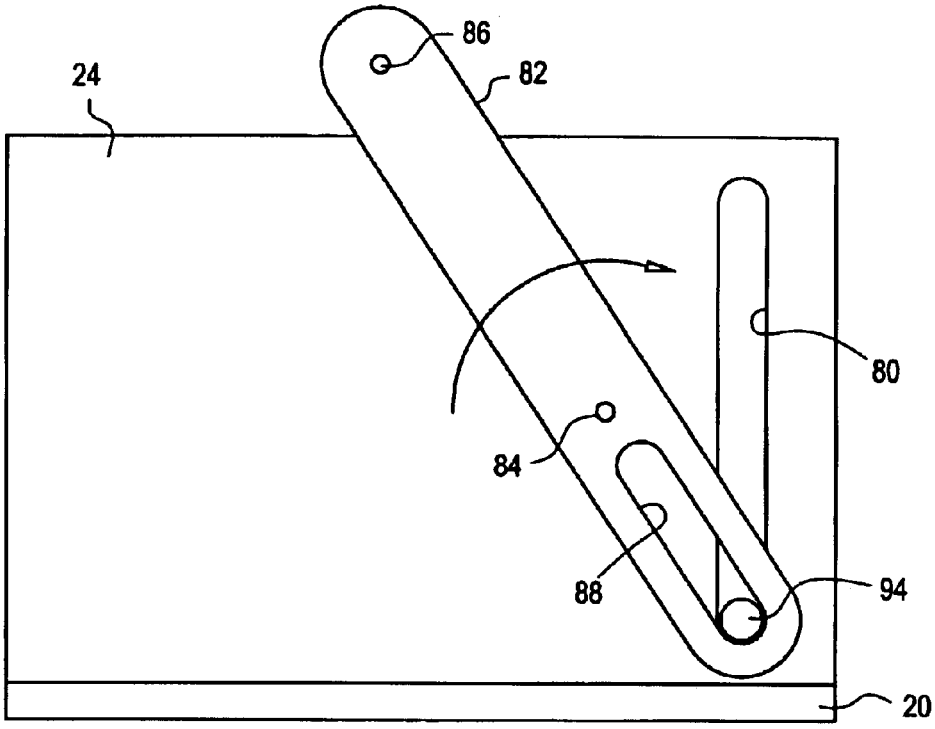
FIGS. 11 and 12 illustrate the operating features of yet another embodiment of the invention.
Figure 12:
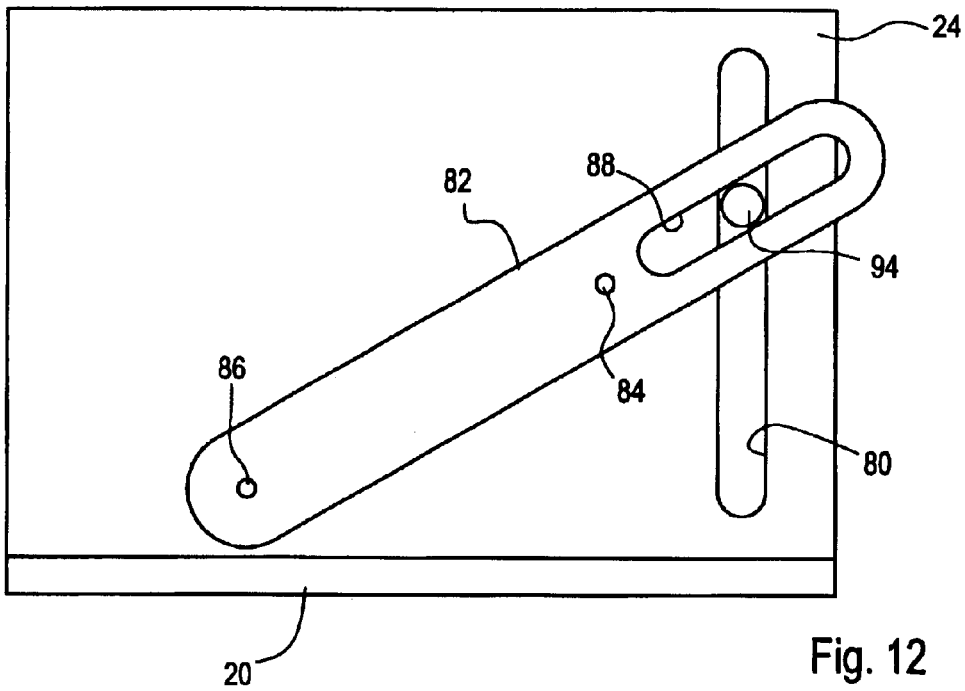

FIGS. 11 and 12 are views taken from the rear side of a plate 24 similar to the views of FIGS. 1, 7, 8, 9 and 10 to illustrate yet another mechanism which combines some of the features of both the embodiment shown in FIGS. 1 through 3 and the embodiment shown in FIGS. 4 through 7. In the embodiment shown in FIGS. 11 and 12, a pivoting lever arm 82 is mounted on a pivot 84 and carries a pin 86, which is similar to the pins 32 and 42 described previously in conjunction with the two embodiments shown in FIGS. 1 through 7. Rotation of the lever arm 82, however, is effected by means of a straight up-and-down reciprocal motion similar to the motion effected by means of the knob 40 in the slot 44 of the embodiment shown in FIG. 6. In the embodiment of FIGS. 11 and 12, a vertical slot 80 is provided near the right-hand edge (as viewed in FIGS. 11 and 12) of the plate 24 and extends from near the bottom of the plate to near the top. An operator shaft 94 is carried at one end of a knob (not shown) similar to the knob 40 of the embodiment of FIG. 6 to enable the shaft 94 to be moved up and down in the slot 80. A similar slot 88 is provided longitudinally on the lever arm 82, as illustrated consequently, when the knob (not shown) is moved to its lowermost position from an upper position, as shown in FIG. 11, the lever arm 82 pivots in the direction of the arrow shown in FIG. 11 to lift the pin 86 to an uppermost position from a lowermost position, thereby dispensing a napkin in the same manner as described in conjunction with the embodiment of FIGS. 1 through 3. Once a napkin has been dispensed, the knob is raised to its uppermost position to cause the lever arm 82 to pivot in the direction of the arrow shown in FIG. 12 to place the pin 86 near the bottom or the base 20, as illustrated in FIG. 12. When the device is in the position shown in FIG. 12, it is ready to be operated again to the position shown in FIG. 11 to dispense the nearest adjacent napkin of the stack 36 from the dispenser in the manner illustrated in FIG. 3.

It should be noted that by placing different dispensing friction members on different front plates 24, as illustrated in FIGS. 1, 6, 7, 8, 9, 10, and 11 and 12, the napkin dispenser may be sold as a kit with two or more of the different dispensing mechanisms included. This allows a purchaser of the kit to decide for himself or herself which one or ones of the friction devices are most suitable for the particular application which is to be made of the dispenser. Since all of the operating mechanisms are carried on the front plate 24, such a kit arrangement is effectively accomplished. In addition, since the front plates 24 are readily attached to and removed from the base 20, as illustrated most clearly in FIG. 8, a simple and effective interchangeability of parts is accomplished.

It also should be noted that the napkin dispensers which have been-described may be made from a variety of different materials. Wood, plastic and metal may be used, as desired.

The foregoing description of the preferred embodiments of the invention is to be considered as illustrative, and not as limiting. Various changes and modifications will occur to those skilled in the art for performing substantially the same function, in substantially the same way, to achieve substantially the same result without departing from the true scope of the invention as defined in the appended claims.

What is claimed is:

1. A napkin dispenser including in combination:

a substantially flat base member adapted to be placed on a horizontal surface to hold a stack of napkins oriented with lower edges of the napkins in the stack resting on the base member;

a substantially flat front plate attached to the base member and extending upwardly therefrom;

a substantially flat rear plate spaced from the front plate and attached to the base member, and extending upwardly therefrom;

a gravity biased weight comprising a pivoted plate having a predetermined height and lower and upper edges, with the lower edge comprising the pivot of the plate and the upper edge engaging a stack of napkins, wherein the lower edge of the weight is located at the junction between the base member and the rear plate for urging a stack of napkins toward engagement with the front plate; and a movable friction member on the front plate for moving a napkin adjacent the front plate upwardly to remove the napkin from the stack of napkins.

2. The napkin dispenser according to claim 1 wherein the front plate is perpendicular to the base member.

3. The napkin dispenser according to claim 2 wherein the front plate is removably attached to the base member.

4. The napkin dispenser according to claim 1 wherein the movable friction member is controlled by a pivoted lever mechanism.

5. The napkin dispenser according to claim 1 wherein the front plate is removably attached to the base member.

6. A napkin dispenser kit including in combination:

a substantially flat base member adapted to be placed on a horizontal surface to hold a stack of napkins oriented with lower edges of the napkins resting on the base member and the primary surfaces of the napkins in the stack oriented substantially perpendicular to the base member;

a plurality of substantially flat front plates each adapted for removable attachment to the base member to extend upwardly therefrom in a substantially perpendicular orientation;

a device for urging a stack of napkins toward engagement with a front plate attached to the base member; and a plurality of different movable friction members each mounted on a different one of the front plates for moving a napkin adjacent the front plate upwardly above the front plate to remove the napkin from a stack of napkins when the front plate is attached to the base member.

7. A napkin dispenser kit according to claim 6 including at least three flat front plates with a first one of the front plates having a friction member operated by a pivoted lever mechanism, a second one of the front plates having a vertically elongated slot therein and having a movable friction member attached to an operator reciprocally mounted in the slot, and the third front panel having an aperture therein with the movable friction member mounted on a rotatable shaft in the aperture, with the axis of the shaft being substantially parallel to the plane of the base member.

8. A napkin dispenser according to claim 6 wherein the device for urging a stack of napkins toward engagement with the front plate is a gravity biased weight which presses on the stack of napkins.

9. The napkin dispenser according to claim 8 wherein the gravity biased weight is a pivoted plate having a predetermined height and lower and upper edges, with the lower edge comprising the pivot of the plate and the upper edge engaging a stack of napkins.

10. A napkin dispenser according to claim 9 further including a substantially flat rear plate spaced from the front plate and attached to the base member, and extending upwardly therefrom.

11. A napkin dispenser according to claim 10 wherein the lower edge of the weight is located at the junction between the base member and the rear plate.

12. A napkin dispenser including in combination:

a substantially flat base member adapted to be placed on a horizontal surface to hold a stack of napkins oriented with lower edges of the napkins in the stack resting on the base member;

a substantially flat front plate attached to the base member and extending upwardly therefrom, the front plate having an elongated slot therethrough extending substantially perpendicularly to the plane of the base member;

a device for urging a stack of napkins toward engagement with the front plate; and a movable friction member mounted for reciprocal movement in the slot on the front plate for moving a napkin adjacent the front plate upwardly to remove the napkin from the stack of napkins.

13. A napkin dispenser including in combination:

a substantially flat base member adapted to be placed on a horizontal surface to hold a stack of napkins oriented with lower edges of the napkins in the stack resting on the base member;

a substantially flat front plate having an aperture therein and attached to the base member and extending upwardly therefrom;

a device for urging a stack of napkins toward engagement with the front plate; and a rotatable friction member including a flexible tongue attached to a pivot rod with an axis parallel to the base member on the front plate, the rotatable friction member extending beyond at least the surface of the front plate which faces the stack of napkins for moving a napkin adjacent the front plate upwardly to remove the napkin from the stack of napkins.

* * * * *